US005176263A

United States Patent [19]

Caruso

[11] Patent Number: 5,176,263

[45] Date of Patent: Jan. 5, 1993

[54] JEWELRY SUPPORT

[76] Inventor: Darlene Caruso, 31 Castledown Rd., Pleasanton, Calif. 94566

[21] Appl. No.: 834,663

[22] Filed: Feb. 12, 1992

[51] Int. Cl.[5] ..... A47F 7/00

[52] U.S. Cl. ..... 211/13; 211/163; 206/495

[58] Field of Search ..... 211/13, 163; 206/6.1, 206/495, 566

[56] References Cited

U.S. PATENT DOCUMENTS 4,848,585 7/1989 Snyder ..... 206/495 X
4,848,586 7/1989 Jasik ..... 206/566
4,978,001 12/1990 Nelson ..... 206/6.1 X
5,054,624 10/1991 Camp ..... 211/13

*Primary Examiner*—Robert W. Gibson, Jr.
*Attorney, Agent, or Firm*—Bielen, Peterson & Lampe

[57] ABSTRACT

A jewelry support utilizing an element extending outwardly along a selected dimension. The element includes an outer skin capable of being repeatedly punctured without substantial damage to the same. A hanger device possessing an elongated member is capable of puncturing the element. The hanger device also includes a tab portion connected to the elongated member which may be engaged by jewelry. The elongated member and tab unit is capable of supporting jewelry to the element when the elongated member punctures the element. The tab is constructed with a friction surface to aid in the support of the jewelry.

7 Claims, 1 Drawing Sheet

JEWELRY SUPPORT

BACKGROUND OF THE INVENTION

The present invention relates to a jewelry support device which is capable of removably holding and displaying jewelry.

Many persons possess a large number of pieces of jewelry for use as ornaments with a variety of items of clothing. As it is desirable to change the jewelry pieces frequently, it is necessary to store the jewelry such that the jewelry may be easily retrieved and used. In the past, storage devices have taken the form of cabinets and boxes. In addition, stands have been devised to store and display jewelry such as those found in the U.S. Pat. Nos. 3,357,570, 3,891,092, 4,442,942, 4,850,658 and 5,052,563.

The U.S. Pat. No. 4,181,224 depicts a jewelry holder and display having a rotatable member with a plurality of holes to hold pierced earrings. U.S. Pat. Nos. 3,997,050 and 4,787,516 teach jewelry displays and holders that employ foam plastic material to accept sharp portions of jewelry such as earrings, broaches, and the like.

Unfortunately, the prior systems proposed, including those using foam plastic material, have a tendency to wear due to constant placement and removal of sharp portions of jewelry.

A jewelry support device which obviates the problems found in the prior art would be a notable advance in the field of merchandise display and storage.

SUMMARY OF THE INVENTION

In accordance with the present invention, a novel and useful jewelry support device is herein provided.

The jewelry support of the present invention utilizes an element extending outwardly along a selected dimension. The element may be of any desired shape, cylindrical, cubical, pyramidal, and the like. The element is also constructed with an outer skin capable of being repeatedly punctured without substantial damage to the same. For example, a tough, plastic foam material would suffice in this regard. In addition, a compartment may be located within the element and include a cover which is removable for access to the compartment. In the case where the element is an upright member, the compartment may be conveniently placed within the top portion of the same. Partitions may also be found in the compartment to segregate to jewelry to different categories and classes. The element may be positioned atop a base which is rotatable, thus permitting availability of the outer skin of the element to a user seated or otherwise placed in a single position.

The jewelry support of the present invention also entails a hanger device possessing a first portion having an elongated member capable of puncturing the element outer skin layer. For example, a pin, post, screw, or the like fall into this category. The hanger device also includes a second portion possessing a tab which may be a flexible plate, that is connected to the elongated member to hang downwardly therefrom. The tab is also formed with an outer friction surface that may be formed integrally with the flexible plate or take the form of a ply having a friction surface which also serves as a spacer.

In another embodiment, the jewelry support hanger device further consists of a bracket having a body which is angularly connected to the tab. The bracket may be formed into a body and a flange which is angularly connected to the body. The elongated member would be capable of penetration of the flange and the element outer skin. Thus, pieces of jewelry may clip onto the plate of the tab and be removable from the same without disturbing the fixation of the hanger device relative to the element.

It may be apparent that a novel and useful jewelry support has been described.

It is therefore an object of the present invention to provide a jewelry support which is convenient and easy to operate.

It is another object of the present invention to provide a jewelry support which possesses a large capacity for storing and displaying jewelry.

A further object of the present invention is to provide a jewelry support which is capable of storing and displaying jewelry possessing both skin puncturing jewelry support mechanisms and jewelry support clipping mechanisms.

Yet another object of the present invention is to provide a jewelry support which is lightweight and yet sturdy in construction.

The invention possesses other objects and advantages as especially as concerns particular characteristics and features thereof which will become apparent as the specification continues.

For a better understanding of the invention, references made to the following detailed description of the preferred embodiments thereof which would be referenced to the hereinabove described drawings.

DETAILED DESCRIPTION OF THE PREFERRED EMBODIMENTS

Figure 1:
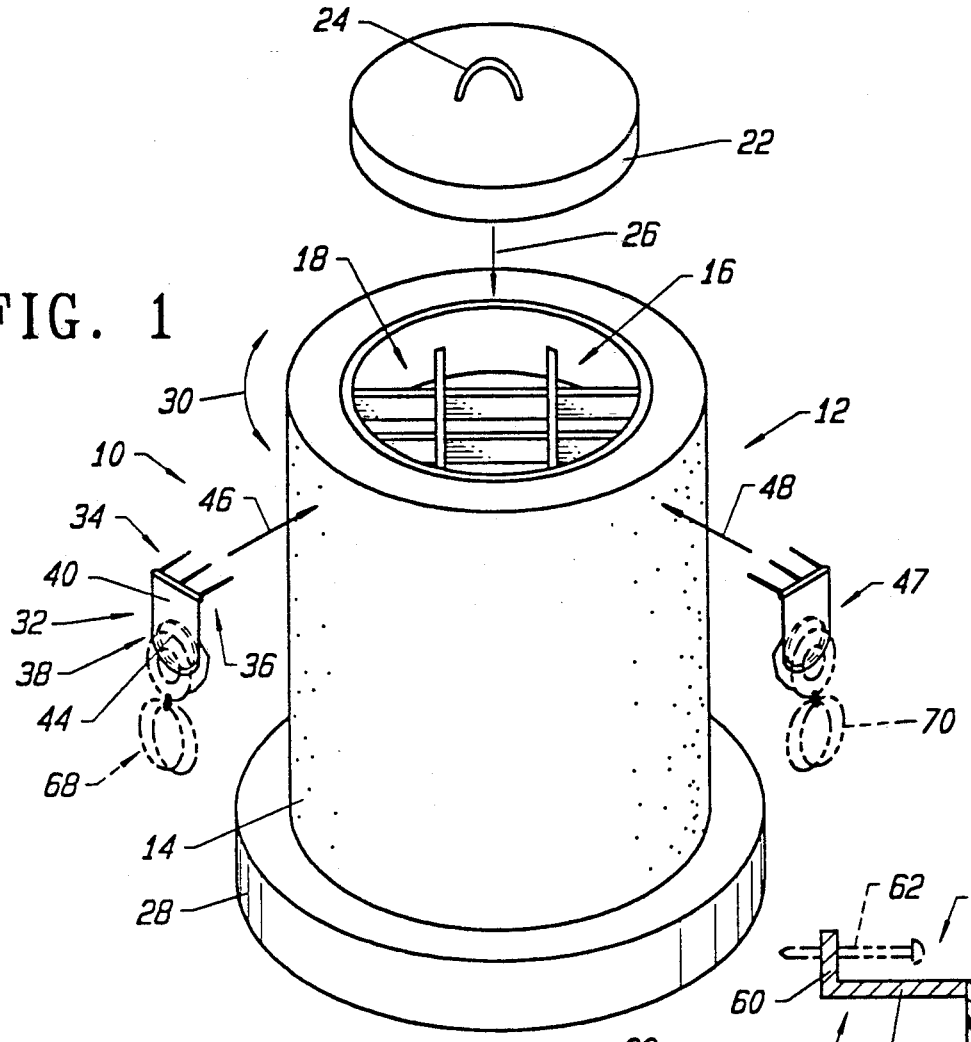
FIG. 1 is a top perspective view of the jewelry support of the present invention with portions shown in exploded configuration.

Various aspects of the present invention will evolve from the following detailed description of the preferred embodiments which should be taken in conjunction with the prior described drawings The invention as a whole is depicted in the drawings by reference character 10. The jewelry holder 10 includes as one of its parts, an element 12 which extends outwardly along a certain dimension. As shown in FIG. 1, element 12 depicts a form of a cylindrical hardened plastic foam block of cylindrical shape. For example, polymeric foams of polyurethane, polystyrene and the like would suffice in this regard. Element 12 includes an outer skin 14 which is capable of being repeatedly punctured by sharp objects without substantial damage. In the embodiment illustrated in FIG. 1, the mono-block construction of element 12 would necessarily provide outer skin 14, although, such outer skin may be laminated or otherwise attached to a core of different material. Element 12 may further include a compartment 16, FIGS. 1 and 2, possessing a plurality of partitions 18 forming a multiplicity of cubicals 20 used to store jewelry items or portions of jewelry items or portions of jewelry items. Cover 22 is removably placed over compartment 16 to protect the contents therewithin. Handle 24 facilitates the placement and removal of cover 22 from element 12 along directional arrow 26. Base 28 also forms a portion of element 12 and includes a swivel mechanism which permits skin surface 14 to rotate according to directional arrow 30.

Figure 2:
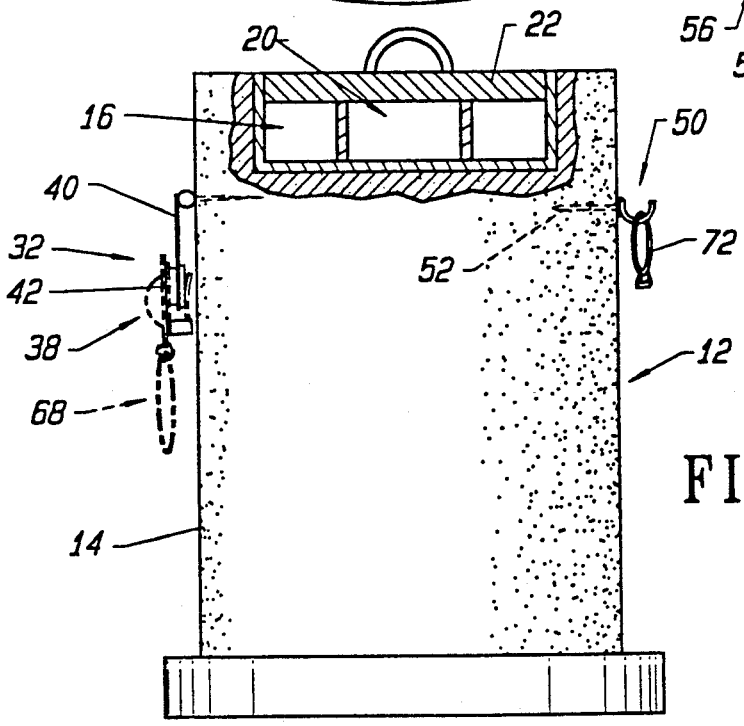
FIG. 2 is a front elevational view of the jewelry support of the present invention with a portion broken away in sections.

Hanger device 32 also forms a portion of jewelry holder 10. Hanger device 32 possesses a first portion 34 constructed with elongated members 36 which are capable of puncturing outer skin 14. With reference to FIG. 1, elongated members 36 are shown as a trio of pins evenly spaced from one another. Elongated members 36 connect to second portion 38 of hanger device 32. Second portion 38 externalizes in a tab 40 which is connected to elongated members 36. Tab 40 is in the form of a flexible plate which generally hangs downwardly from first portion 34 of hanger device 32. Spacer 42 is fixed to tab 40 and includes a friction surface 44. For example, tab 40 may be constructed of a plastic material while spacer 42 may be formed of a felt material Hanger device 47, FIG. 1, is similarly constructed to hanger device 32. Hanger devices 32 and 47 penetrate outer skin 14 of element 12 and move according to directional arrows 46 and 48 in order to puncture outer skin 14 of element 12. FIG. 2 represents element 32 being held to element 12 by trio of elongated members 36. It should be noted that a conventional hook 50, FIG. 2, possessing a pin 52 for puncturing outer skin 14 and may also be employed with jewelry holder 10

Figure 3:
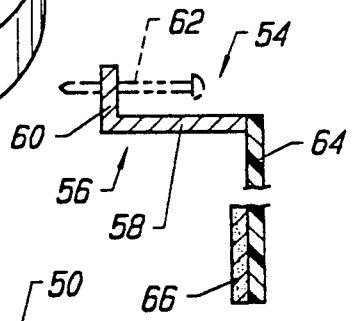
FIG. 3 is a sectional view of another embodiment of the hanger device portion of the present invention.

Turning now to FIG. 3, it may be observed that another embodiment 54 of a hanger device useable with element 12 is depicted. Embodiment 54 is shown in FIG. 3 as possessing a bracket 56 including a body 58 and an angularly connected flange 60 a fastener such as pin 62. Pin 62 is capable of passing through flange 60 which may be constructed of suitable material such as paper, metal, and the like. Bracket 56 exhibits sufficient rigidity to extend outwardly from element 12 when flange 60 lies against outer skin 14. Tab 64 having a spacer 66 similar to spacer 42 connects to body 58.

In operation, the user directly attaches jewelry having penetrating parts such as pins directly through outer skin 14 of element 12. In addition, jewelry such as jewelry pieces 68 and 70, representing an earring for non-pierced ears, clip onto the tab portions of hanger devices 32 or 47. Friction surface 44 of spacer 42 aids in the holding of jewelry pieces 68 and 70 to hanger devices 32 and 47. Of course, hanger devices 32 and 47 penetrate outer skin 14 of element 12 being pushed toward element 12 according to directional arrows 46 and 48. Conventional hook and pin 50 and 52 may also be pushed through outer skin 14 of element 12 to hold ring 72, or other jewelry pieces such as necklaces, bracelets and the like. Hanger device 54 is fixed to element 12 by pin 62 which penetrates outer skin 14. Body 58 holds tab 64 apart from outer surface 14 thus, supporting jewelry pieces such as earrings 68 and 70 which are bulky. Element 12 may then be rotated relative to swivel base 28 according to directional arrow 30 for display when the user is selecting a particular piece of jewelry. Compartment 16 may be employed to store other items such as earring posts, broaches, and the like.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A jewelry support comprising:

a. an element extending outwardly along a selected dimension, said element including an outer skin capable of being repeatedly punctured without substantial damage to said skin; and b. a hanger device including a first portion having an elongated member capable of puncturing said element, a second portion extending from said first portion, said second portion including a tab capable of being engaged by jewelry, said tab including a friction surface, said first portion elongated member being capable of supporting said hanger device and engaged jewelry to said element.

2. The jewelry support of claim 1 which additionally comprises said tab being composed of a plate of flexible material 3. The jewelry support of claim 2 in which said friction surface of said tab includes a ply of material attached to said tab, said ply of material further consisting a spacer adjacent said plate of flexible material.

4. The jewelry support of claim 1 which additionally comprises a base portion connected to said element and being rotatable about an axis.

5. The jewelry support of claim 1 which additionally comprises a compartment located within said element 6. The jewelry support of claim 5 in which said compartment includes a removable cover for gaining access to said compartment.

7. The jewelry support of claim 1 in which said hanger device further includes bracket having a body angularly connected to said tab and a flange angularly connected to said body, said flange being capable of penetration by said elongated member.

* * * * *